US006039306A

United States Patent [19]

Pericard et al.

[11] Patent Number: 6,039,306

[45] **Date of Patent: *Mar. 21, 2000**

[54] AEROSOL VALVE

[75] Inventors: Louis Pericard, Hattersheim, Germany; Georges Guillemot, Plaisir, France

[73] Assignee: Precision Valve Corporation, Yonkers, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/003,766

[22] Filed: Jan. 7, 1998

[51] Int. Cl.[7] ..... B65D 83/00

[52] U.S. Cl. ..... 251/353; 251/354; 222/402.24

[58] Field of Search ..... 222/402.24; 251/353, 251/354

[56] References Cited

U.S. PATENT DOCUMENTS 2,862,648 12/1958 Ciiksley et al. ..... 251/353
3,294,118 12/1966 Wieden et al. ..... 251/354
3,313,459 4/1967 Mizuguchi ..... 251/354
3,830,412 8/1974 Green ..... 222/402.24

*Primary Examiner*—A. Michael Chambers
*Attorney, Agent, or Firm*—Kilgannon & Steidl

[57] ABSTRACT

The aerosol valve of this invention in its novel aspects comprises a valve stem having an enlarged body portion beneath the valve stem, the body portion having a tubular portion extending from its base and a valve housing having an upstanding tubular portion with a sloped upper portion terminating in a shoulder, which sloped upper portion and sloped shoulder are designed to receive the tubular portion extending from the base of the body portion in a sealed relationship when the valve stem is manually advanced to an open position. Conventional aerosol valve components such as the encircling gasket for sealing the valve stem orifice(s), a spring for returning the valve stem/body to a closed position upon release of manual pressure to the valve stem, a dip tube extending downwardly from a nipple at the base of the housing and a mounting cup for affixing the valve unit to the cup and ultimately to an aerosol container also form parts of the aerosol valve of this invention.

5 Claims, 3 Drawing Sheets

AEROSOL VALVE

This invention relates to an aerosol valve having a structure that will preclude, during propellant filling of the container, the passage of propellant into the dip tube of the valve and structure allowing subsequent use of the aerosol valve as either a metering valve or a non-metering continuous flow valve.

BACKGROUND OF THE INVENTION

Generally, an aerosol valve comprises a hollow valve stem that has a valve actuator disposed atop the stem. The valve stem has a wider body portion at its base that is disposed within the aerosol container. The valve stem is disposed such that the valve stem emerges through a central opening in the pedestal portion of a mounting cup. Beneath the underside of the pedestal is a gasket which encircles a lateral orifice in the hollow valve stem and acts to seal the orifice in the valve stem when the valve is in a closed position. Beneath the gasket and clinched within the pedestal portion of the mounting cup is a valve housing; the valve housing surrounding the lower portion of the valve stem disposed within the container. A spring is disposed within the housing between the base of the housing and the valve body at the base of the valve stem. Extending below the housing is a hollow nipple for receiving a dip tube, which dip tube extends to the bottom of the container and functions as the conduit to deliver product/propellant to the interior of the housing. The valve is opened by either vertically depressing the valve stem to remove the gasket from the valve stem orifice and expose said orifice to the container contents or the valve stem is laterally moved, so-called tilt valve, to separate the gasket and the valve stem orifice and to thus expose the stem orifice to the container contents. Release of manual pressure on the valve stem causes the valve to return to its closed position; the spring functioning to press the valve body toward the gasket.

Metering valves are old in the aerosol industry. In the usual metering valve structure, product and propellant pass into the interior of the valve housing through a dip tube when the aerosol valve is in the closed position. During actuation or opening of the valve by manual pressure on the valve stem, valve structure is present that interrupts product/propellant flow from the dip tube to the interior of the housing. Thus, the discharge of product/propellant during the period that the valve is open will be limited to that amount of product/propellant present in the interior of the valve housing. When the manual pressure is released from the valve stem, the valve will close and the product/propellant will again flow into the interior of the valve housing. This closed/open cycle of the valve is repeated and each cycle will discharge a regulated amount of product/propellant. U.S. Pat. No. 3,658,214 ('214) is an example of a metering valve wherein flow from the dip tube to the interior of the housing is interrupted by having an upwardly extending tubular member situated in the valve housing pass in sealing contact with an opening on the base of the valve stem when the valve stem is depressed to a valve open position; the product/propellant passing through the dip tube being blocked from passing beyond the seal between tubular member and the opening in the base of the valve stem. Obviously, to create an effective seal according to the structure of the '214 patent demands a precise size tolerance between the sealing surfaces of the tubular member and the interior sealing surface of the opening in the base of the valve stem. In a massed-produced item such as an aerosol valve, this needed close tolerance is difficult to attain and maintain through the life of the use of the mold. Poor tolerance quality will result in a leak path for the product/propellant to the interior of the valve housing and consequent discharge when the valve is open (poor metering) or difficulty in actuating the valve to a valve open position where the tolerance error is an oversize in one or both sealing surfaces.

For certain applications, in particular, non-medical applications, the amount of product to be delivered by the aerosol metering valve is not critical, i.e., there can be a variation in the precise amount discharged upon actuation or opening of the valve and the metering valve still serves an important function. Thus, the aerosol industry has need of a valve which assuredly will seal off access to the dip tube during pressure filling of the container with propellant; for a metering valve that assuredly will shut off flow from the container into the interior of the valve housing when the valve is opened and for a valve having the structural capability of functioning as a metering valve or a continuous discharge valve; the ultimate functioning of the valve as a metering valve or a continuous valve being determined at the time of the initial actuation of the valve, i.e., at the time of propellant filling.

The subject invention accomplishes the aforementioned needs.

SUMMARY OF THE INVENTION

The aerosol valve of this invention in its novel aspects comprises a valve stem having an enlarged body portion beneath the valve stem, the body portion having a tubular portion extending from its base and a valve housing having an upstanding tubular portion with a sloped upper portion terminating in a shoulder, which sloped upper portion and sloped shoulder are designed to receive the tubular portion extending from the base of the body portion in a sealed relationship when the valve stem is manually advanced to an open position. Conventional aerosol valve components such as the encircling gasket for sealing the valve stem orifice(s), a spring for returning the valve stem/body to a closed position upon release of manual pressure to the valve stem, a dip tube extending downwardly from a nipple at the base of the housing and a mounting cup for affixing the valve unit to the cup and ultimately to an aerosol container also form parts of the aerosol valve of this invention.

When it is desired to fill an aerosol container having the valve of this invention with propellant through pressure filling, the valve stem is depressed so as to seal the tubular extension from the base of the valve body onto the upper sloped portion of the upstanding tubular portion at the base of the valve housing. Unsealing the mating tubular portions by releasing manual force on the valve stem will operate to close the valve. Subsequent intermittent depression of the valve stem to seal the tubular extension from the base of the valve body onto the sloped terminus of the upstanding tubular portion will produce a series of metered discharges of product/propellent from the aerosol container.

When it is desired to use the aerosol valve as a continuous discharge valve rather than a metered valve, the filling head delivering propellant to the aerosol container is advanced an additional increment to force the leading edge of the tubular extension from the valve body onto the sloped shoulder disposed immediately beneath the sloped terminus of the upstanding tubular portion in the housing; the consequence of said advancement being to splay the leading edge of the valve body tubular extension and thereby create a permanent flow path from the dip tube to the interior of the valve housing.

IN THE DRAWINGS

FIG. 4 is a partial cross-sectional view of the metering valve of this invention as delivered prior to filling an associated aerosol container (not shown) with propellant (same as FIG. 1).

FIG. 5 is a partial cross-sectional view of this invention in the valve-open position during pressure filling of an associated aerosol container (not shown) with propellant and with the valve stem advanced beyond that shown in FIG. 2.

FIG. 6 is a partial cross-sectional view of the valve of FIG. 5 in the valve-closed position.

FIG. 7 is a partial cross-sectional view of the valve of FIG. 5 in the valve-open position during discharge of product from an associated aerosol container (not shown).

DETAILS OF THE INVENTION

Figure 3:
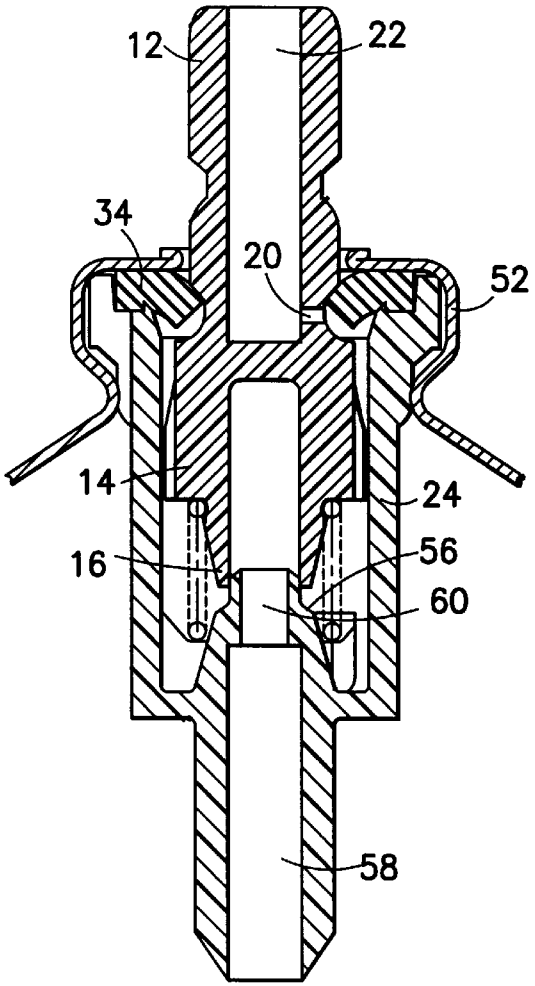
FIG. 3 is a partial cross-sectional view of the metering valve of this invention in the valve-open position during discharge of product from an associated aerosol container (not shown).

The aerosol valve of this invention, generally designated as 10, comprises a hollow valve stem 12 having an enlarged valve body 14, which valve body has a tubular portion 16 extending from the base 18 of the valve body 14 and terminating in a leading edge 17. A valve stem orifice 20 extends laterally through the valve stem 12 and communicates at its radially inward opening with the conduit 22 in the valve stem 12. Surrounding the valve body 14 and the valve stem orifice 20 is a valve housing 24, which valve housing 24 has an upstanding tubular member 26 extending from the base 28 of the housing 24. Extending downwardly from the housing 24 is a nipple 30 to which is affixed a dip tube (not shown) which extends to the bottom of an associated aerosol container (not shown). Disposed atop the upper edge 32 of the housing 24 is a gasket 34, which is disposed in the valve stem groove 36 and encircles in a sealed relationship the valve stem orifice 20 disposed in said groove 36. A spring 38 is disposed between the base 18 of the valve body 14 and the base 40 of the housing 24. The valve housing 24 has an upper portion 42 having an annular recess 44 in which is disposed the gasket 34. The upstanding wall 46 defining the annular recess 44 is a castellated wall having openings 48 and downwardly extending slots 50 which communicate with the interior of an associated aerosol container (not shown). The housing 24 having a castellated peripheral wall defining the gasket recess and downwardly extending slots is more fully described in U.S. Pat. No. 4,015,757, the disclosure of said patent being incorporated by reference herein and made a part of this disclosure. The valve, generally designated as 10, is affixed to a mounting cup 52 (shown in partial cross-section) in a conventional manner.

The upstanding tubular member 26 of the valve housing 24 has an outwardly and downwardly sloped terminal edge 54 and disposed below and contiguous to the sloped terminal edge 54, an outwardly and downwardly sloped annular shoulder 56.

Figure 2:
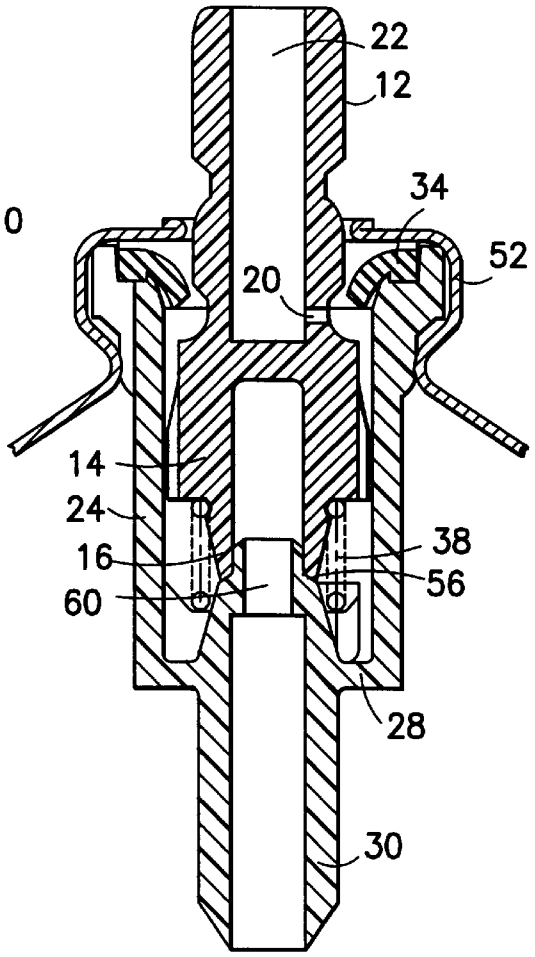
FIG. 2 is a partial cross-sectional view of the metering valve of this invention in the valve-open position during pressure filling of an associated aerosol container (not shown) with propellant.

The tubular portion 16 and the upstanding tubular member 26 are designed such that advancing the valve stem 12 and valve body 14 within the housing 24 will result in the tubular portion 16 engaging the sloped terminal edge 54 in a sealing relation (best shown in FIGS. 2 and 3).

Figure 1:
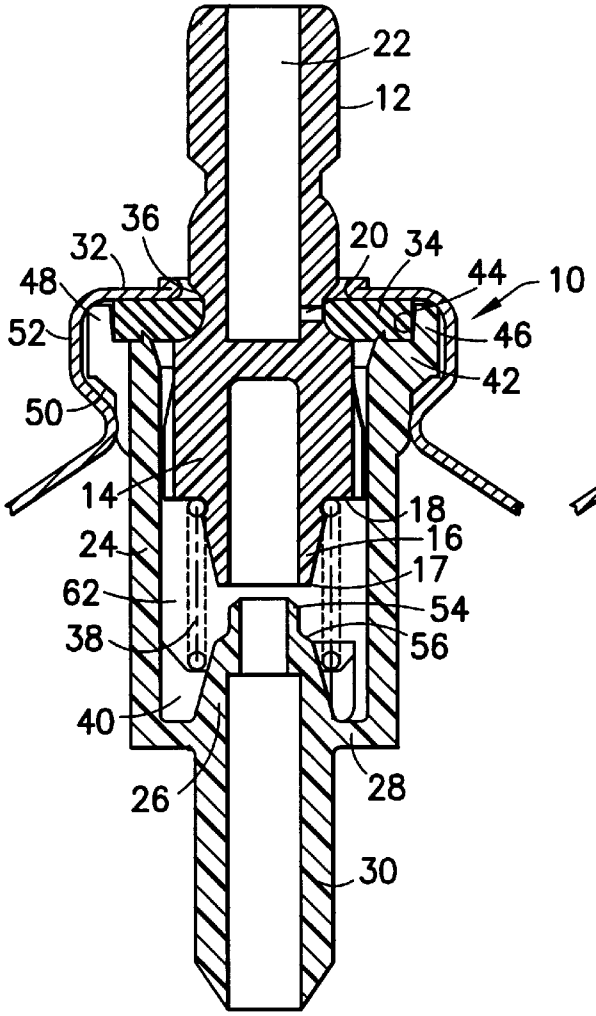
FIG. 1 is a partial cross-sectional view of the metering valve of this invention in the valve-closed position.
Figure 5:
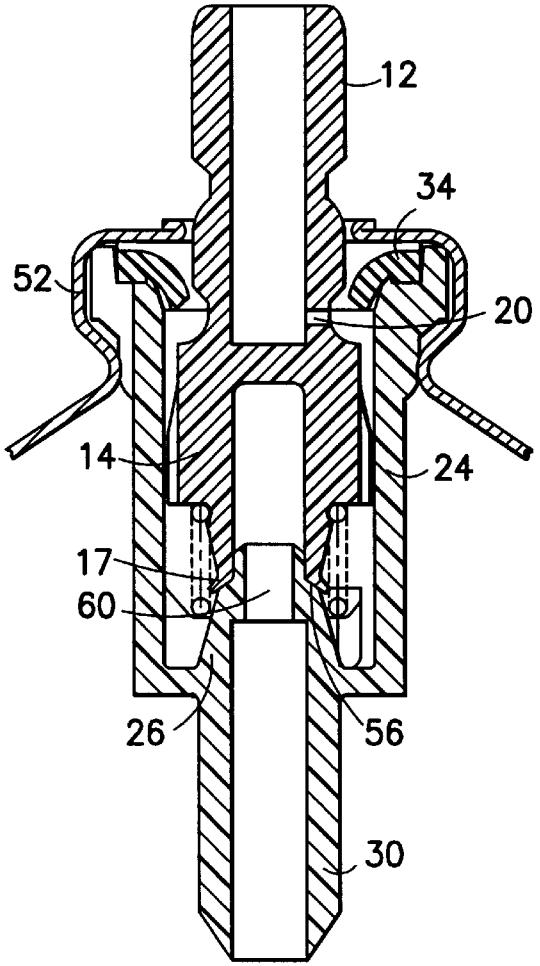
FIGS. 4–7 show the sequence of steps in the conversion of the aerosol valve of this invention to a continuous spray valve.
Figure 4:
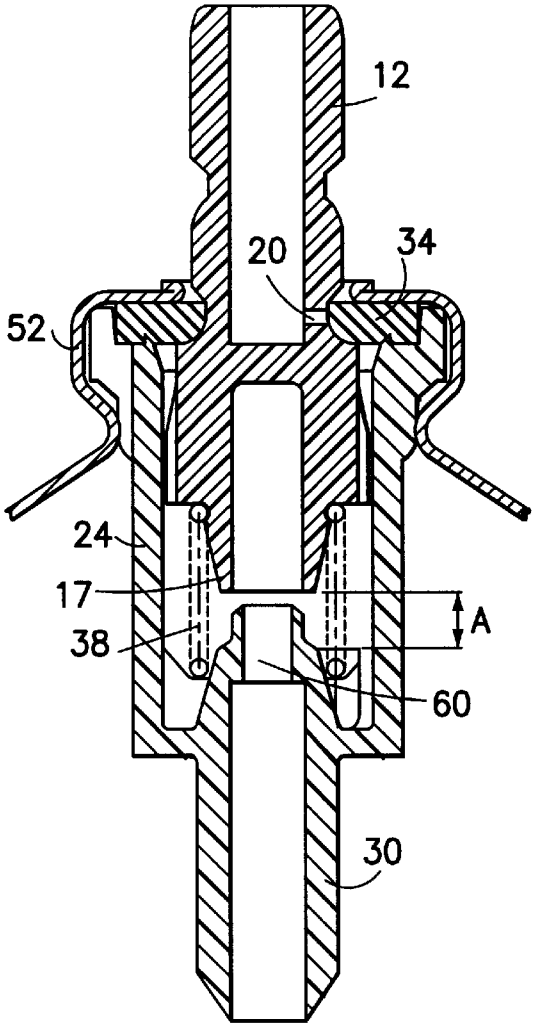
Figure 7:
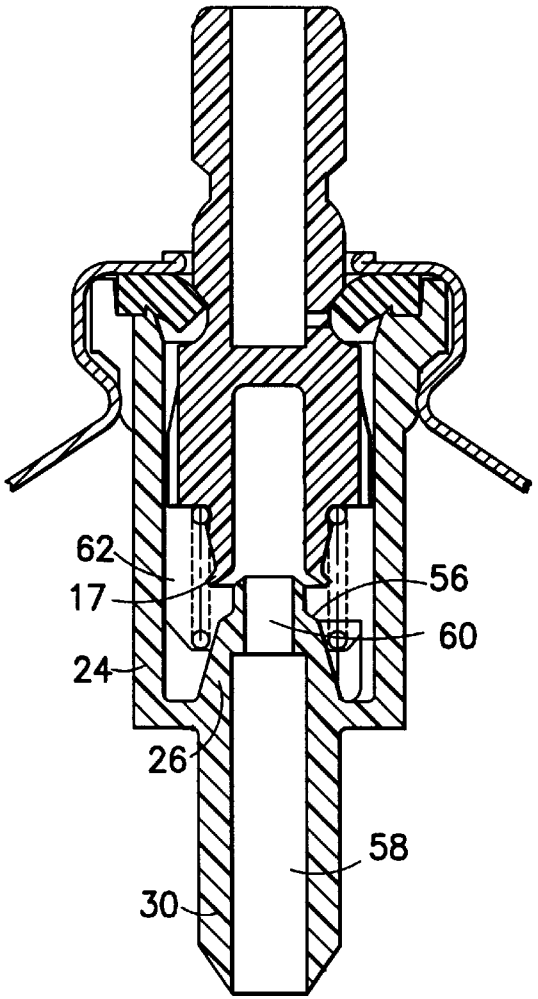
Figure 6:
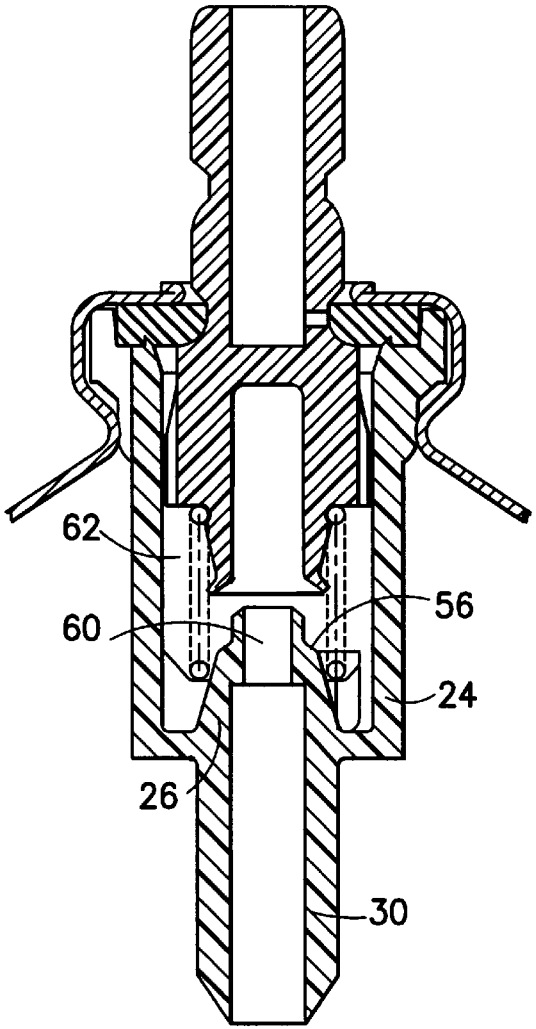

Corresponding parts in FIGS. 2–7 have similar designations as set forth for the valve structure of FIG. 1. However, as shown in FIGS. 5–7, the leading edge 17 of the tubular portion 16 is permanently splayed. The splaying of the leading edge 17 is accomplished during the filling of the aerosol container (not shown) by advancing the leading edge 17 onto the outwardly sloped annular shoulder 56. As shown in FIG. 7, the permanent splaying of the leading edge 17 provides a flow path between the interior 62 of the valve housing 24 the conduit 58 in the nipple 30, the conduit 60 in the upstanding tubular member 26.

The advantage of the sealing structure of this invention is the assured sealing resulting from mating an advancing tubular member onto a fixed sloped surface. This, in contrast to slidable sealing structures wherein the mating surfaces have to be sized with tight tolerances in order for the seal to be effective.

In operating as a metering valve (see FIGS. 1–3), depressing the valve stem will cause the downwardly extending tubular member to seal against the outer surface of the tubular member extending upwardly from the base of the housing, thereby closing the interior of the valve housing to flow of product/propellant from an associated aerosol container. Concomitantly, depressing the valve stem will operate to move the valve to a valve-open position and cause the product/propellant in the interior of the housing (the metering chamber) to egress through the valve stem orifice to a discharge orifice situated in an actuator (not shown) atop the valve stem. Removal of the force effecting the depressing of the valve stem, will cause the valve to return to a valve-closed position (see FIG. 1).

In operating as a continuous flow valve, FIGS. 6–7, depressing the valve stem having a tubular member depending from the valve body, which tubular member has a splayed leading edge, will move the valve to a valve-open position and allow for a continuous flow of product/propellant from an associated aerosol container to a discharge orifice located in an actuator atop the valve stem so long as the valve stem is held in a depressed position and the valve is open.

Although specific examples of the invention have been shown for purposes of disclosure, it is to be understood that various modifications can be made therefrom without departing from the spirit and scope of the invention.

We claim:

1. In an aerosol valve comprising a hollow valve stem having a valve body at the base of the valve stem and a gasketed valve stem orifice, a valve housing surrounding the gasketed portion of the valve stem and the valve body, wherein said valve stem moves reciprocally within said valve housing in response to the presence or absence of manual force against the valve stem and, further, wherein there is a conduit for the flow of product/propellant from an associated pressurized aerosol container to the interior of the valve housing, the improvement comprising the base of the valve body having a tubular extension depending therefrom and the base of the valve housing having an upstanding tubular portion, which tubular extension may advance and abut against a surface of the upstanding tubular portion to form a seal between the tubular extension and the upstanding tubular portion to thereby preclude flow of product/propellant to the valve stem orifice when the valve is in an open position.

2. The improvement of claim 1, and further wherein at least one of the abuting surfaces forming a seal between the tubular extension and the upstanding tubular portion is sloped.

3. The improvement of claim 2, and further wherein the upstanding tubular portion has a terminal portion which is sloped upwardly and radially inward.

4. The improvement of claim 3, and further wherein the upstanding tubular portion has a portion contiguous to the terminal portion which is an annular shoulder.

5. The improvement of claim 4, and further wherein the annular shoulder contiguous to the terminal portion of the upstanding tubular portion is sloped in a direction away from and radially outward from the terminal portion.

* * * * *